US011518587B2

(12) United States Patent
Miceli et al.

(10) Patent No.: US 11,518,587 B2
(45) Date of Patent: Dec. 6, 2022

(54) CLOSURE SYSTEM FOR DISPLAYING CUSTOM IMPRINTED LINERS

(71) Applicant: Altium Healthcare Inc., Atlanta, GA (US)

(72) Inventors: David A. Miceli, Reno, NV (US); Joseph A. Miceli, Spencer, TN (US)

(73) Assignee: Altium Healthcare Inc., Atlanta, GA (US)

( * ) Notice: Subject to any disclaimer, the term of this patent is extended or adjusted under 35 U.S.C. 154(b) by 129 days.

(21) Appl. No.: 16/285,260

(22) Filed: Feb. 26, 2019

(65) Prior Publication Data

US 2020/0270035 A1 Aug. 27, 2020

(51) Int. Cl.
*B65D 51/24* (2006.01)
*B65D 41/04* (2006.01)

(52) U.S. Cl.
CPC ..... *B65D 51/245* (2013.01); *B65D 41/04* (2013.01); *B65D 2203/02* (2013.01)

(58) Field of Classification Search
CPC .. B65D 51/245; B65D 41/04; B65D 2203/02; B65D 45/325; B65D 45/322; B65D 45/32; B65D 43/0225; B65D 43/0231; B65D 51/18; B65D 51/24; B65D 2251/023
USPC ..... 220/288, 259.3, 376, 377; 206/459.5, 206/534
See application file for complete search history.

(56) References Cited

U.S. PATENT DOCUMENTS 2,450,949 A * 10/1948 Gattuccio ..... A61J 7/04 116/308
3,048,301 A * 8/1962 Arpin ..... G04B 39/004 220/664
3,923,183 A * 12/1975 Choksi ..... A61J 1/05 215/251
4,069,935 A * 1/1978 Hampel ..... B65D 50/041 215/203
4,747,499 A * 5/1988 Gach ..... B65D 51/145 215/250
4,747,500 A * 5/1988 Gach ..... B65D 55/02 215/250

(Continued)

OTHER PUBLICATIONS

Pro Plus Series, Tri State Distribution, https://www.provial.com/infoproplus.php, accessed Feb. 18, 2019, 2 pages.

*Primary Examiner* — Robert Poon
(74) *Attorney, Agent, or Firm* — Luedeka Neely Group, P.C.

(57) ABSTRACT

A closure system including a transparent inner cap, an opaque outer cover, and a liner. The transparent inner cap includes a top wall, an open bottom, a sidewall, and an inner cap attaching mechanism disposed on an exterior surface of the sidewall. The opaque outer cover includes an open top, an open bottom, a sidewall, and an outer cover attaching mechanism disposed on an interior surface of the sidewall. The opaque outer cover is dimensioned and configured to be assembled with the transparent inner cap via the corresponding attaching mechanisms to form an assembled two-piece closure with the opaque outer cover substantially covering the sidewall of the transparent inner cap. The liner is operable to be inserted into the two-piece closure such that the liner is visible through the open top of the opaque outer cover and the top wall of the transparent inner cap.

6 Claims, 3 Drawing Sheets

(56) References Cited

U.S. PATENT DOCUMENTS

| | | | | |
|---|---|---|---|---|
| 5,242,067 | A * | 9/1993 | Garby | A61J 7/04 215/216 |
| 5,579,934 | A | 12/1996 | Buono | |
| 5,791,506 | A | 8/1998 | Sheffler et al. | |
| 6,802,427 | B2 | 10/2004 | Miceli et al. | |
| 7,124,904 | B1 | 10/2006 | Miceli et al. | |
| 7,857,134 | B2 * | 12/2010 | Koch | A61J 7/04 206/534 |
| 8,209,944 | B1 | 7/2012 | Miceli et al. | |
| 8,662,331 | B2 | 3/2014 | Miceli et al. | |
| 8,881,988 | B2 | 11/2014 | Miceli et al. | |
| 9,782,327 | B2 | 10/2017 | Miceli et al. | |
| 10,052,258 | B2 | 8/2018 | Miceli et al. | |
| 2007/0051690 | A1 | 3/2007 | Hidding | |
| 2008/0073312 | A1 * | 3/2008 | Babcock | B65D 41/0485 215/305 |
| 2010/0038279 | A1 * | 2/2010 | Estep | B65D 21/0231 206/534 |
| 2012/0033898 | A1 * | 2/2012 | Barron | B65D 47/242 383/61.1 |
| 2016/0023812 | A1 * | 1/2016 | Kikel | B65D 53/02 235/492 |
| 2017/0139217 | A1 * | 5/2017 | Crenko | G02B 27/027 |
| 2017/0225843 | A1 * | 8/2017 | Glaser | B65D 21/02 |
| 2017/0231867 | A1 * | 8/2017 | Maston | B65D 50/06 206/534 |
| 2018/0037382 | A1 * | 2/2018 | Huss | B65D 1/10 |
| 2019/0031410 | A1 * | 1/2019 | Vazquez | B65D 51/145 |

* cited by examiner

CLOSURE SYSTEM FOR DISPLAYING CUSTOM IMPRINTED LINERS

FIELD

This disclosure relates to closures for containers. More particularly, this disclosure relates to a two-piece closure system for pharmaceutical containers designed to display custom imprinted liners that can be selected for insertion into the closure system based on a desired message.

BACKGROUND

There are many types of closure systems described in the art. While many of these closures provide information such as an indication of the contents of the particular container to which the closure is applied (e.g., "2%" on a closure for a milk container), warning messages (e.g., "Warning—This cap is Non-Child Resistant"), operating instructions (e.g., "To open, push-down-and-turn"), etc., the message is typically molded or imprinted directly into the top of the closure. In other words, the particular message is permanent to the particular closure to which the message is applied.

Further, in order to efficiently make the closure with the molded or imprinted message, the message for the particular closure must be selected and applied to the closure at generally the same time the closure is being manufactured (i.e., either included within the mold when the message is molded to the top of the container or in a separate manufacturing step when the message is imprinted to the top of the closure). However, in many instances, it may be desirable to assign a message to a particular closure at a time after the closure is manufactured and/or at a location that is different from where the closure is being manufactured. For example, a pharmacy will order closures from a bottle/closure manufacturer. While manufacturers are starting to provide options for the pharmacy to select messages to be included on particular closures, the pharmacy must select the particular message far in advance of when the closure will actually be used in order to be molded or imprinted to the closure by the manufacturer. This makes it very difficult or otherwise prevents any type of time-sensitive information to be displayed by the closure. Similarly, if the message is no longer applicable or desired, the pharmacy must either dispose of the closure or use the closure with the non-applicable message. Thus, to prevent wasting closures or using closures to display inapplicable messages, pharmacies will most likely stick to generic messages such that the closures can be used for a significant amount of time or otherwise will not have to be replaced due to the expiration of time-sensitive information in the message.

In light of the foregoing, what is needed in the art is a closure system that is efficient to manufacture while also providing for custom messages to be selected and displayed by the closure after its manufacture.

SUMMARY

The above and other needs are met by a closure system including a transparent inner cap, an opaque outer cover, and a liner. The transparent inner cap includes a top wall, an open bottom, a sidewall extending down from the top wall to the open bottom, a closure engaging mechanism disposed on an interior surface of the sidewall configured to contact and interact with a corresponding container engaging mechanism for removably applying the closure system to a container, and an inner cap attaching mechanism disposed on an exterior surface of the sidewall. The opaque outer cover includes an open top, an open bottom, a sidewall extending down from the open top to the open bottom, and an outer cover attaching mechanism disposed on an interior surface of the sidewall. The opaque outer cover is dimensioned and configured to be assembled with the transparent inner cap to form an assembled two-piece closure wherein the sidewall of the opaque outer cover substantially covers the sidewall of the transparent inner cap and the outer cover attaching mechanism engages the inner cap attaching mechanism for affixing the opaque outer cover to the transparent inner cap. The liner is operable to be inserted into a cavity formed between the top wall and the sidewall of the transparent inner cap such that the liner is visible through the open top of the opaque outer cover and the top wall of the transparent inner cap of the assembled two-piece closure.

According to certain embodiments, the sidewall of the transparent inner cap and the sidewall of the opaque outer cover are circumferential and the liner is disc-shaped to correspond with the cavity formed by the circumferential sidewall of the transparent inner cap.

According to certain embodiments, the sidewall of the transparent inner cap includes an inner cap circumference that is substantially the same as an outer cover circumference of the sidewall of the opaque outer cover.

According to certain embodiments, the inner cap attaching mechanism includes a plurality of vertical ribs and the outer cover attaching mechanism includes a plurality of vertical ribs configured to engage the plurality of vertical ribs of the inner cap for affixing the opaque outer cover to the transparent inner cap.

According to certain embodiments, each of the interior surface of the sidewall of the opaque outer cover and the exterior surface of the sidewall of the transparent inner cap include one of a protruding section and a recessed section. The protruding section is operable to engage the recessed section for permanently affixing the opaque outer cover to the transparent inner cap. In some embodiments, the opaque outer cover includes the protruding section, the transparent inner cap includes the recessed section, the inner cap attaching mechanism is disposed within the recessed section of the transparent inner cap, and the outer cover attaching mechanism is disposed on the protruding section of the opaque outer cover. According to some embodiments, the protruding section includes an angled surface. In certain embodiments, the exterior surface of the sidewall of the transparent inner cap includes an angled surface adjacent the open bottom where the angled surface of the transparent inner cap corresponds to the angled surface of the protruding section of the outer cover to facilitate assembly of the two-piece closure.

According to certain embodiments, the closure system further includes a plurality of liners each including different indicia for insertion into the cavity of the assembled two-piece closures based on the indicia of the liner selected for insertion.

According to another embodiment, a closure system includes an opaque outer cover, a transparent inner cap, and a liner. The opaque outer cover includes an open top, an open bottom, a circumferential sidewall extending down from the open top to the open bottom, and an outer cover attaching mechanism disposed on an interior surface of the sidewall. The transparent inner cap includes a top wall, an open bottom, a circumferential sidewall extending down from the top wall to the open bottom, a closure engaging mechanism disposed on an interior surface of the sidewall configured to contact and interact with a corresponding container engaging mechanism for removably applying the closure system to a container, and an inner cap attaching mechanism disposed on an exterior surface of the sidewall. The transparent inner cap is dimensioned and configured to be inserted into the opaque outer cover to form an assembled two-piece closure wherein the sidewall of the opaque outer cover substantially covers the sidewall of the transparent inner cap and the outer cover attaching mechanism engages the inner cap attaching mechanism for affixing the opaque outer cover to the transparent inner cap.

The exterior surface of the sidewall of the transparent inner cap includes an angled surface adjacent the open bottom to facilitate traversal of the exterior surface of the sidewall of the transparent inner cap along the side wall of the interior surface of the opaque outer cover during assembly of the assembled two-piece closure. The liner is disc-shaped and is operable to be inserted into a cavity formed between the top wall and the circumferential sidewall of the transparent inner cap such that the liner is visible through the open top of the opaque outer cover and the top wall of the transparent inner cap of the assembled two-piece closure.

According to another embodiment of the disclosure, a method of providing information to a user of a closure system includes the step of providing a two-piece closure including a transparent inner cap and an opaque outer cover. The transparent inner cap includes a top wall, an open bottom, a sidewall extending down from the top wall to the open bottom, a closure engaging mechanism disposed on an interior surface of the sidewall configured to contact and interact with a corresponding container engaging mechanism for removably applying the closure system to a container, and an inner cap attaching mechanism disposed on an exterior surface of the sidewall. The opaque outer cover includes an open top, an open bottom, a sidewall extending down from the top wall to the open bottom, and an outer cover attaching mechanism disposed on an interior surface of the sidewall. The opaque outer cover is dimensioned and configured to be assembled with the transparent inner cap to form an assembled two-piece closure wherein the sidewall of the opaque outer cover substantially covers the sidewall of the transparent inner cap and the outer cover attaching mechanism engages the inner cap attaching mechanism for affixing the opaque outer cover to the transparent inner cap. The method further includes providing a liner to be inserted into a cavity formed between the top wall and the sidewall of the transparent inner cap with the liner including indicia printed on at least one side of the liner and inserting the liner into the cavity formed between the top wall and the sidewall of the transparent inner cap such that the indicia of the liner is visible through the open top of the opaque outer cover and the top wall of the transparent inner cap of the assembled two-piece closure.

According to certain embodiments, the method further includes providing a plurality of liners each having different indicia information printed thereon and selecting the liner to be inserted into the cavity from the plurality of liners based on the desired indicia information to be visible to the user when using the assembled two-piece closure.

According to certain embodiments, the indicia of the liner includes dosage information specific to the user of the closure system. According to some embodiments, the method further includes printing the dosage information at the pharmacy.

According to certain embodiments, the indicia of the liner includes time-sensitive promotional information.

According to certain embodiments, the inner cap attaching mechanism includes a plurality of vertical ribs and the outer cover attaching mechanism includes a plurality of vertical ribs. According to this embodiment, the method further includes assembling the two-piece closure by inserting the transparent inner cap into the opaque outer cover such that the plurality of vertical ribs of the transparent inner cap engage the plurality of vertical ribs of the opaque outer cover to affix the opaque outer cover to the transparent inner cap. In certain embodiments, each of the interior surface of the sidewall of the opaque outer cover and the exterior surface of the sidewall of the transparent inner cap include one of a protruding section and a recessed section. According to this embodiment, the assembling step further includes inserting the transparent inner cap into the opaque outer cover until the protruding section engages the recessed section for permanently affixing the opaque outer cover to the transparent inner cap. In some embodiments, the opaque outer cover includes the protruding section and the transparent inner cap includes the recessed section. According to this embodiment, the inner cap attaching mechanism is disposed within the recessed section of the transparent inner cap and the outer cover attaching mechanism is disposed on the protruding section of the opaque outer cover.

According to certain embodiments, the protruding section includes an angled surface. In some embodiments, the exterior surface of the sidewall of the transparent inner cap includes an angled surface adjacent the open bottom. According to this embodiment, the angled surface of the transparent inner cap corresponds to the angled surface of the protruding section of the outer cover to facilitate assembly of the two-piece closure.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

The disclosure relates to a closure system primarily directed for use with containers intended to store and dispense pharmaceutical products and the like. More specifically, the closure system is intended to provide a pharmacy or other dispensing entity the ability to quickly and efficiently provide custom information to a user of the closure system. However, it should be understood that the teachings of the present disclosure may be utilized with other closure systems irrespective of the intended purpose of the container to which the closure system is used in situation in which it would be useful to display custom information.

Figure 1A:
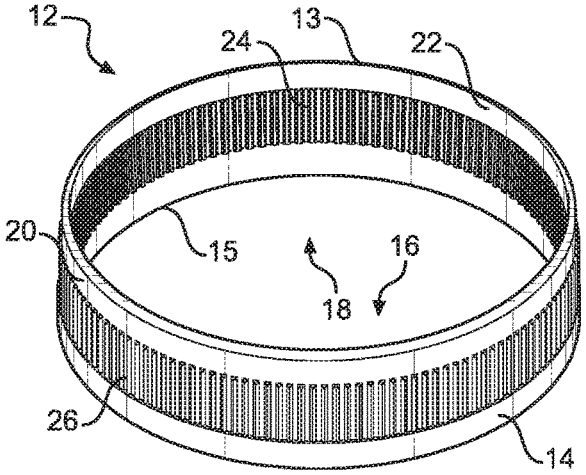
FIG. 1A is an overhead perspective view of an opaque outer cover according to one embodiment of the disclosure.
Figure 1D:
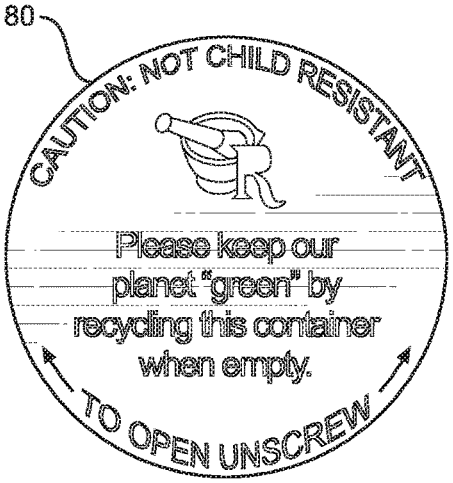
FIG. 1D is a top view of a liner dimensioned and configured for insertion into the assembled two-piece closure system according to one embodiment of the disclosure.
Figure 1B:
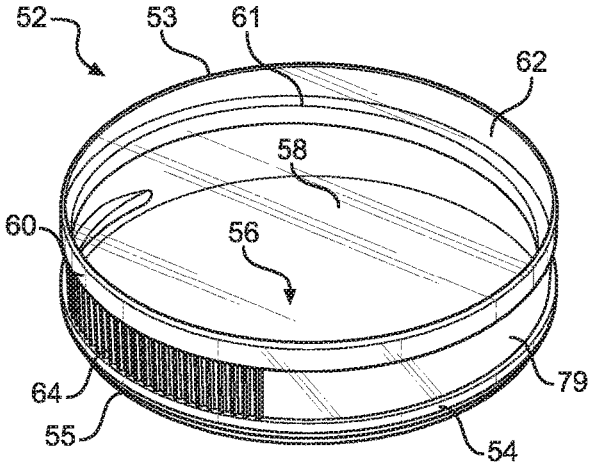
FIG. 1B is an overhead perspective view of a transparent inner cap according to one embodiment of the disclosure.
Figure 1E:
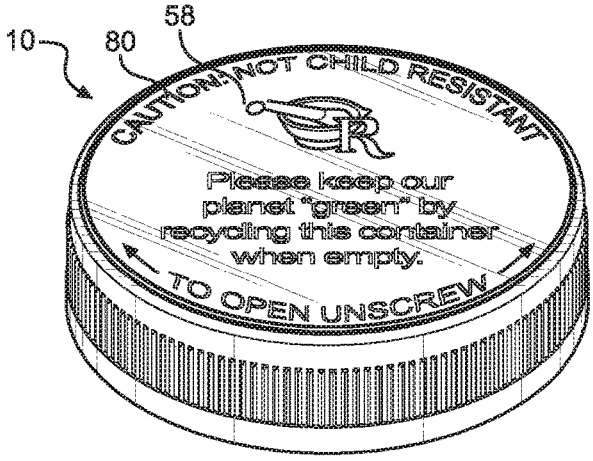
FIG. 1E is an overhead perspective view of the assembled two-piece closure system of FIG. 1C with the liner of FIG. 1D inserted into the assembled closure system such that the liner is viewable through the top of the transparent inner cap according to one embodiment of the disclosure.
Figure 1C:
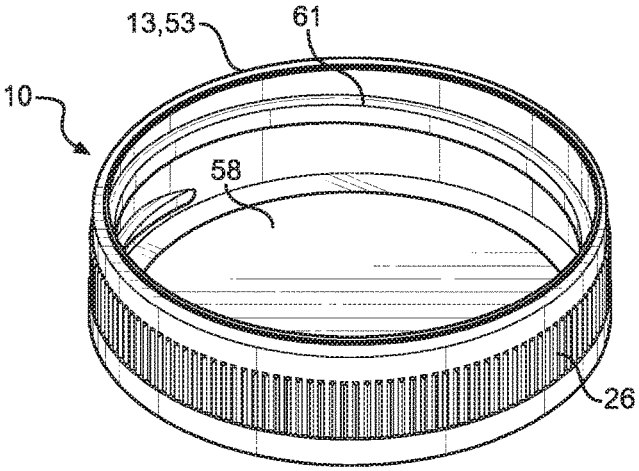
FIG. 1C is an overhead perspective view of the transparent inner cap of FIG. 1B assembled with the opaque outer cover of FIG. 1A to form an assembled two-piece closure system according to one embodiment of the disclosure.

Referring first to FIGS. 1A-1E, a two-piece closure system 10 according to the present disclosure includes an opaque outer cover 12 as exemplified in FIG. 1A and a transparent inner cap 52 as exemplified in FIG. 1B. As explained further below, the opaque outer cover 12 and transparent inner cap 52 are configured to be easily assembled together as exemplified in FIG. 1C to form the two-piece closure system 10 where the opaque outer cover 12 covers the sidewall 54 of the transparent inner cap 52 while allowing the solid top 58 of the inner cap 52 to be visible through an open top 18 in the outer cover 12. A liner 80 as exemplified in FIG. 1D is dimensioned and configured to be inserted into the two-piece closure system 10 for displaying custom information/messages to a user of the closure system 10 through the solid top 58 of the transparent inner cap 52 as exemplified in FIG. 1E.

Referring more specifically to FIG. 1A, the opaque outer cover 12 is opaque as result of being molded from one resin material that forms a non-transparent / opaque cover in a singular injection molding process. The opaque outer cover 12 includes a sidewall 14 having an upper end 13 and a lower end 15, an open bottom 16 adjacent the lower end 15, and an open top 18 adjacent the upper end 13. In certain embodiments, the open top 18 may include a rim extending from the top end 13 inward towards the radial center of the outer cover 12. However, in preferred embodiments, the sidewall 14 is circumferential without any type of top rim (i.e., the open top 18 extends across the entirety of the space between opposite ends of the sidewall 14) such that the opaque outer cover 12 is generally ring-shaped as shown in FIG. 1A.

With continued reference to FIG. 1A, the sidewall 14 of the opaque outer cover 12 includes an exterior surface 20 and an interior surface 22. At least a portion of the interior surface 22 includes an outer cover attaching mechanism 24. While various attaching mechanisms may be utilized within the teachings of the present disclosure, the outer cover attaching mechanism 24 according to preferred embodiments is in the form of a plurality of vertical ribs as shown, which are configured to engage similarly configured vertical ribs 64 of inner cap 52 as further explained below. In preferred embodiments, at least a portion of the exterior surface 20 may also include knurlments 26 similar to the vertical ribs of the outer cover attaching mechanism 24. To minimize width of the sidewall 14, at least a portion of the sidewall 14 in certain embodiments may be formed of the vertical ribs such that the same ribs provide both a gripping element when a user grasps the exterior surface 20 of the outer cover 12 and provide the outer cover attaching mechanism 24 of the interior surface 22.

Referring to FIG. 1B, and in contrast to the opaque outer cover 12, the transparent inner cap 52 is transparent as a result of being molded from a separate resin in another singular injection molding process that forms the transparent inner cap 52. The transparent inner cap 52 includes a sidewall 54 having an upper end 53 and a lower end 55, an open bottom 56 adjacent the lower end 55, and a solid top 58 adjacent the upper end 53. The sidewall 54 includes an exterior surface 60 and an interior surface 62. The interior surface 62 includes a container engaging mechanism 61 that is dimensioned and configured to contact and interact with a corresponding engaging mechanism on a container (not shown) for removably applying the closure system to the container as known in the art. In other words, the transparent inner cap 52 in preferred embodiments is intended to be a fully functioning closure with a sidewall 54, an open bottom 56 for placing over a corresponding container, a container engaging mechanism 61 for securing the inner cap 52 to the container, and a solid top 58 for closing the opening of the container when the inner cap is secured to the container using container engaging mechanism 61. In typical embodiments, the container engaging mechanism 61 is in the form of one or more threads configured to engage one or more corresponding threads disposed on a neck of the container. However, other container engaging mechanisms 61 such as beads, cams, lugs and the like are possible and within the scope of the present disclosure.

In preferred embodiments, the sidewall 54 of inner cap 52 is circumferential to match the circumferential sidewall 14 of the outer cover 12. According to this embodiment, the liner 80 is preferably disc-shaped with generally the same diameter as the internal diameter of the inner cap 52 such that the liner may be secured underneath the solid top 58 of the inner cap 52 by inserting the liner 80 through the open bottom 56 and into the cavity formed by the sidewall 54 and solid top 58.

With continued reference to FIG. 1B, the transparent inner cap 52 further includes an inner cap attaching mechanism 64 disposed on at least a portion of the exterior surface 60 of sidewall 54. The inner cap attaching mechanism 64 corresponds to the outer cover attaching mechanism 24 such that the inner cap attaching mechanism 64 is configured to engage the outer cover attaching mechanism 24 to assemble the inner cap 52 to the outer cover 12. Thus, in preferred embodiments, the inner cap attaching mechanism 64 includes a plurality of vertical ribs that correspond to the plurality of ribs of the outer cover attaching mechanism 24. According to this embodiment, the exterior surface 60 of the sidewall 54 of the transparent inner cap 52 includes an inner cap circumference that is substantially the same as an outer cover circumference of the interior surface 22 of the sidewall 14 of the opaque outer cover 12. As a result, when the sidewall 14 of the outer cover 12 and sidewall 54 of inner cap 52 are circumferentially shaped, the external diameter of the inner cap 52 (i.e., diameter through axial center of inner cap 52 to opposite ends of exterior surface 60 of sidewall 54) and internal diameter of the outer cover 12 (i.e., diameter through the axial center of outer cover 12 to opposite ends of the interior surface 22 of sidewall 14) are substantially the same such that ribs 24 of the outer cover 12 mate/engage with the ribs 64 of the inner cap 52 to prevent axial rotation of the outer cover 12 with respect to the inner cap 32 when the inner cap 52 is pushed into the outer cover 12 (or the outer cover is slid around the inner cap 52). It should be understood that other forms of attaching mechanisms 24, 64 may be utilized within the scope of the present disclosure including, without limitation, tongue-and-groove assembly, male/female attaching mechanisms, etc.

In preferred embodiments, to assemble the two-piece closure system 10, the transparent inner cap 52 is intended to be pushed down through the open top 18 of the opaque outer cover 12 (or opaque outer cover 12 pushed up through the open bottom 56 of the transparent inner cap 52) such that the exterior surface 60 of sidewall 54 of the transparent inner cap 52 traverses the interior surface 22 of outer cover 12 until the inner cap attaching mechanism 64 fully engages the outer cover attaching mechanism 24. Upon the inner cap attaching mechanism 64 engaging the outer cover attaching mechanism 24, the opaque outer cover 12 is affixed to the transparent inner cap 52. For purposes of the present disclosure, the term "affixed" or "affixing" refers to the outer cover 12 being unable to be axially rotated without also rotating the inner cap 52. In other words, following assembly of the opaque outer cover 12 to the transparent inner cap 52, the attaching mechanisms 24, 64 prevent any independent rotation of the outer cover 12 around the inner cap 52 or any independent rotation of the inner cap 52 within the outer cover 12. Similarly, as rotation of the outer cover 12 causes corresponding rotation of the inner cap 52, the assembled closure system 10 may be installed or removed from a corresponding container by axially rotating outer cover 12, which in turn rotates the inner cap 52 to install or remove the closure system 10 from the container vis-à-vis rotation of the container engaging mechanism 61.

Figure 2:
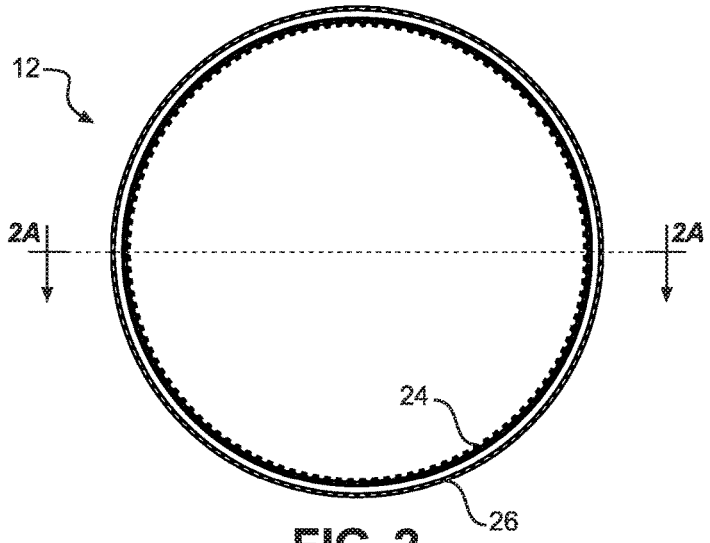
FIG. 2 is a top view an opaque outer cover according to one embodiment of the disclosure.
Figure 2A:
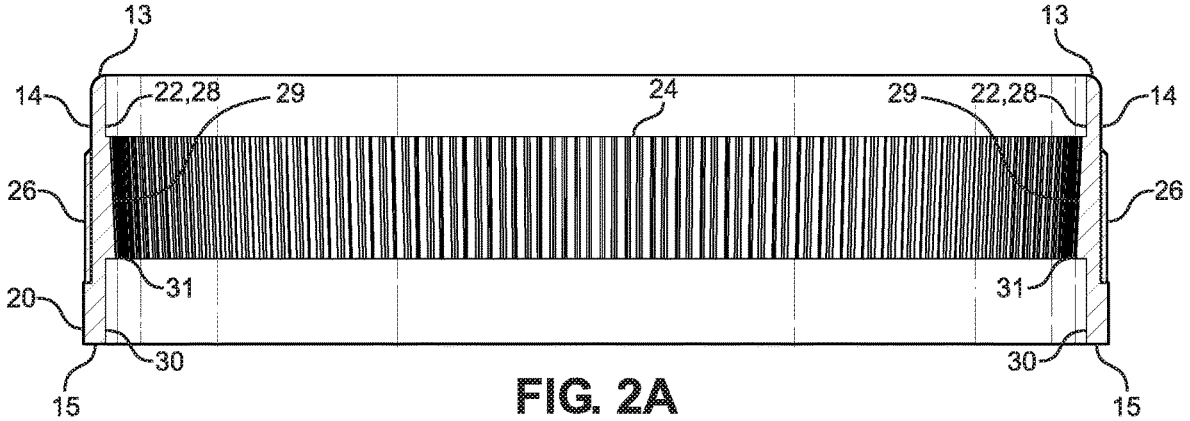
FIG. 2A is a cross-sectional view of the opaque outer cover taken along line 2A of FIG. 2.

According to another aspect of the disclosure, the interior surface 22 of the sidewall 14 of outer cover 12 and the exterior surface 60 of the sidewall 54 of inner cap 52 are preferably dimensioned and configured to permanently affix the outer cover 12 to the inner cap 52 upon assembly. For purposes of the present disclosure, the phrase "permanently affix" or "permanently affixing" refers to the assembled closure system preventing both independent rotation of the outer cover 12 and inner cap 52 as well as preventing any vertical movement of the inner cap 52 within the outer cover 12 following assembly (i.e., prevent potential disassembly and/or shelling of the assembled two-piece closure system after assembly). In this regard, as best shown FIG. 2A, which is a cross-sectional view of opaque outer cover 12 taken along line 2A of FIG. 2, the interior surface 22 of sidewall 14 of outer cover 12 preferably includes an upper portion 28 adjacent the upper end 13, a lower portion 30 adjacent the open lower end 15, and a slightly protruding middle section 29 containing the vertical ribs 24 disposed between the upper portion 28 and lower portion 30. As a result of the slightly protruding middle section 29, the ribs 24 of outer cover 12 extend slightly into the open interior portion of the outer cover 12 as compared to upper portion 28 and lower portion 30.

Figure 3:
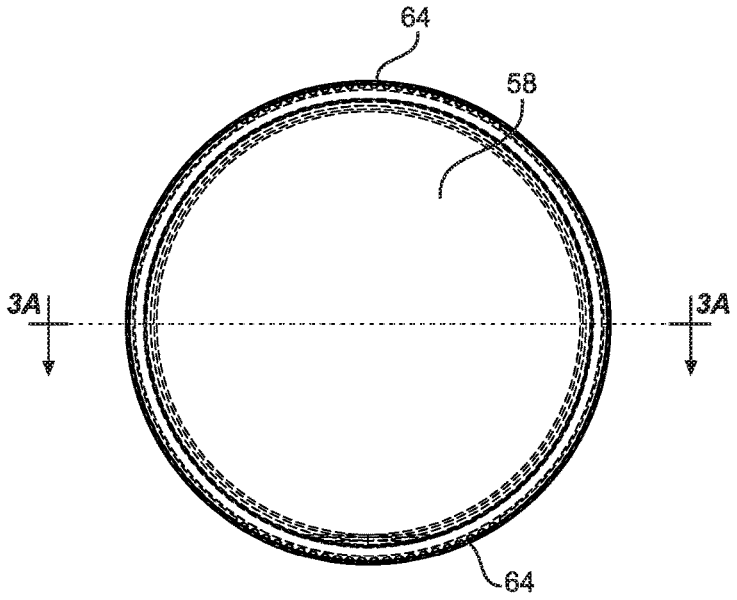
FIG. 3 is a top view of a transparent inner cap of FIG. 1B according to one embodiment of the disclosure.
Figure 3A:
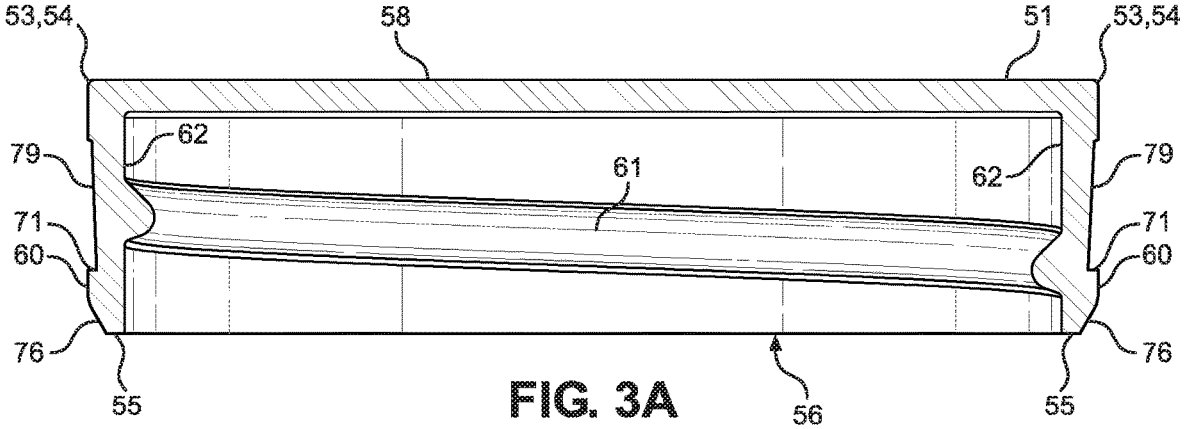
FIG. 3A is a cross-sectional view of the transparent inner cap taken along line 3A of FIG. 3.

As best shown in FIG. 3A, which is a cross-sectional view of transparent inner cap 52 taken along line 3A of FIG. 3, the exterior surface 60 of sidewall 54 of inner cap 52 includes a corresponding recessed middle section 79. As shown in FIGS. 1B and 3, the ribs 64 of inner cap 52 are disposed in a portion of the recessed middle section 79 while other portions of middle section 79 lack the ribs 64. Thus, when the two-piece closure system is assembled according to this embodiment, the ribs 24 of the protruding middle section 29 of outer cover 12 are configured to either mate/engage with corresponding ribs 64 of the recessed middle section 79 of inner cap 52 to prevent axial rotation of outer cover 12 independently of inner cap 52 or, when aligned with the recessed middle section 79 without ribs 64, to be inserted into the recessed middle section 79 to permanently affix the outer cover 12 to the inner cap 52 (i.e., prevent undesirable shelling or removal of the outer cover 12 from the inner cap 52). In certain embodiments, one or more ribs may also be dispersed in the portions of middle section 79 that lacks ribs 64 to provide structural support for the middle section 79.

Figure 4:
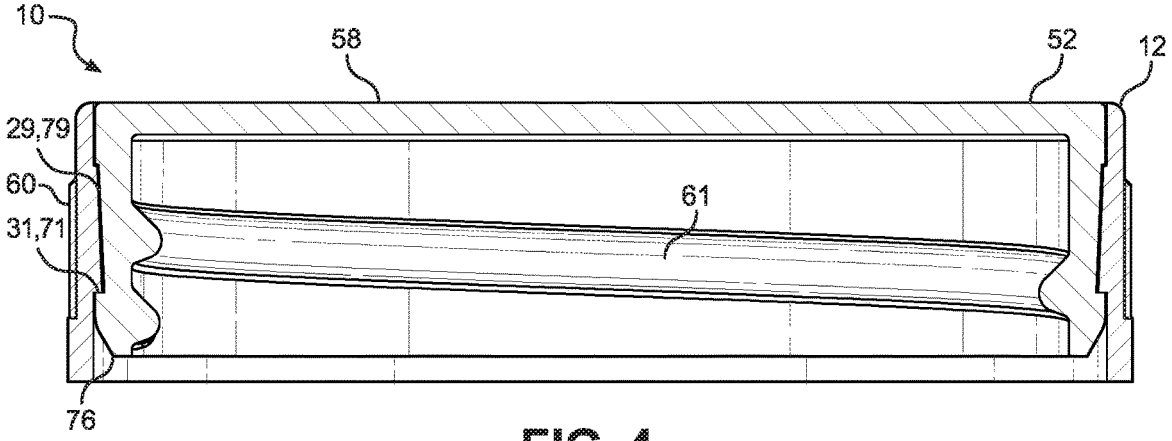
FIG. 4 is a cross-sectional view of an assembled two-piece closure system according to one embodiment of the disclosure.

According to another aspect of the disclosure, and with reference again to FIGS. 2A, the protruding middle section 29 of outer cover 12 preferably protrudes at a slight angle beginning adjacent the bottom of upper portion 28 and abruptly ending adjacent the top of the lower portion 30 to form a sharp edge 31 that extends generally perpendicular to the sidewall 14 (it is noted that the angle could begin adjacent the top of the lower portion and extend to the bottom of the upper portion 28 in a less desirable embodiment where the outer cover 12 is pushed down with respect to the inner cap 52). Accordingly, the angle of the protruding middle section 29 provides a ramp or inclined surface to facilitate traversal of the exterior surface 60 of sidewall 54 of inner cap 52 with respect to the interior surface 22 of sidewall 14 of outer cover 12 until the protruding middle section 29 of outer cover 12 "snaps" into the recessed middle section 79 of inner cap 52 as exemplified in FIG. 4, which depicts a cross-sectional view similar to FIGS. 2A and 3A of the assembled closure system 10. The assembly of the protruding middle section 29 is referred to as "snapping" into the recessed middle section 79 as a result of the sidewall 24 of outer cover 12 and/or sidewall 54 of inner cap 52 slightly deforming during traversal of the exterior surface 60 of sidewall 54 along the angled middle section 29 of sidewall 24 until the sidewalls snap back to their undeformed state when the protruding middle section 29 is fully inserted into the recessed middle section 79 to complete the assembly process.

To further facilitate assembly, and with reference again to FIG. 3A, sidewall 54 of inner cap 52 preferably includes an angled surface 76 adjacent the lower end 55 of the exterior surface 60. Angled surface 76 of inner cap 52 also ends at a sharp edge 71 extending towards the interior of the inner cap generally perpendicular to sidewall 54 adjacent the recessed middle section 79. Thus, during assembly, the leading angled surface 76 of inner cap 52 is able to ride the ramp provided by the angled middle section 29 of the outer cover 12 to facilitate sliding of the inner cap 52 within the outer cover 12 while further preventing unwanted shelling after assembly as a result of the sharp edge 31 of the outer cover 12 engaging the sharp edge 71 of the inner cap 52 when the outer cover 12 and inner cap 52 are assembled together as described above and shown in FIG. 4.

The closure system 10 of the present disclosure has several advantages. First, by providing a closure system with a transparent top, an entity using the closure system 10 to close a corresponding container is able to quickly select a particular message that will be visible to the user of the closure system 10. For example, a pharmacy or other dispensing entity may print or otherwise have in stock a plurality of pre-printed liners 80 having different indicia displayed thereon corresponding to different messages. Alternately, the pharmacy could provide "on demand" printing of the liner during the normal prescription label printing process. At the time of dispensing a prescribed pharmaceutical to a particular customer, the pharmacy can select one of the liners 80 based on the preferred indicia/message the pharmacy would like to be displayed to the particular customer by inserting the selected liner 80 into the inner cap 32. Similarly, the pharmacy could order a supply of two-piece closure systems 10 from a closure manufacturer while having the ability to later select the particular message to be displayed to their customers by varying the message of the liners 80 inserted into the inner cap 32. For example, a pharmacy may order a two-month supply of closure systems 10. During the first month, the closure systems 10 are used to display a particular promotion having an expiration date at the end of the month. Thus, the pharmacy is able to insert liners 80 corresponding to the first promotion for the minimum expected supply of closure systems 10 to be used for the first month. If more closure systems are needed during the first month, liners 80 with the first promotion may then be inserted into additional closure systems from the two-month supply while maintaining the ability to use the rest of the second month supply for a to-be-determined promotion.

Another advantage of the closure system 10 of the present disclosure is the ability to efficiently manufacture a closure system 10 for displaying custom messages through a transparent top while maintaining an aesthetically appealing and more traditional appearance of the overall closure system 10. In this regard, the assembled closure system 10 with a transparent top as a result of the transparent inner cap 32 and an opaque sidewall as a result of the opaque outer portion 12 provides a more aesthetically appealing closure system as compared to a one-piece closure formed of a resin that results in a closure that is entirely transparent. Further, while a co-injection process may be used to form a one-piece closure with a transparent top and an opaque sidewall using two different resins, the co-injection process is unduly expensive, slow, and requires additional machinery.

Yet another advantage of the closure system 10 of the present disclosure is the ability to modify the type of information that is able to be displayed by the liners 80 as generally described in U.S. Pat. No. 8,881,988, which is commonly assigned to the owners of the present application and the disclosure of which is incorporated by reference herein in its entirety. In particular, because the desired message can be selected following manufacture of the closure system, it is much easier to customize the information to a particular customer. In certain embodiments, the customized information may be promotional information as described above. For example, a pharmacy may want to use certain liners 80 for one group of customers (e.g., elderly, customers taking specific medications, etc.) while using liners 80 with a different message for another group of customers. In other embodiments, and particularly for customers that are prescribed multiple medications according to a medication synchronization program, liners 80 may be designed to include specific dosage information for a particular prescription being dispensed in the container to which the closure system 10 is being applied as described in U.S. Pat. No. 9,782,327, which is commonly assigned to the owners of the present application and the disclosure of which is incorporated by reference herein in its entirety.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A closure system comprising:

an opaque outer cover having an open top, an open bottom and a circumferential sidewall extending down from the open top to the open bottom, the circumferential sidewall of the opaque outer cover including a protruding middle section extending radially around an interior surface of the sidewall;

a transparent inner cap including a top wall, an open bottom, a circumferential sidewall extending down from the top wall to the open bottom, and a closure engaging mechanism disposed on an interior surface of the sidewall configured to contact and interact with a corresponding container engaging mechanism for removably applying the closure system to a container, the circumferential sidewall of the transparent inner cap including a recessed middle section extending radially around an exterior surface of the sidewall, the transparent inner cap dimensioned and configured to be inserted into the opaque outer cover such that the protruding middle section of the outer cover is inserted into the recessed middle section of the inner cap for affixing the opaque outer cover to the transparent inner cap such that the opaque outer cover is unable to be axially rotated without a corresponding rotation of the transparent inner cap to form an assembled two-piece closure wherein the sidewall of the opaque outer cover substantially covers the sidewall of the transparent inner cap; and a disc-shaped liner operable to be inserted into a cavity formed between the top wall and the circumferential sidewall of the transparent inner cap such that the liner is visible through the open top of the opaque outer cover and the top wall of the transparent inner cap of the assembled two-piece closure, wherein the exterior surface of the sidewall of the transparent inner cap includes an angled surface adjacent the open bottom that is angled inwardly toward the open bottom of the transparent inner cap to facilitate traversal of the exterior surface of the sidewall of the transparent inner cap along the sidewall of the interior surface of the opaque outer cover when the transparent inner cap is pushed through the open top of the opaque outer cover during assembly of the assembled two-piece closure.

2. The closure system of claim 1 wherein the protruding middle section includes an angled surface and the recessed middle section includes a corresponding angled surface to facilitate assembly of the two-piece closure.

3. The closure system of claim 1 wherein the transparent inner cap includes a plurality of vertical ribs disposed in the recessed middle section and a plurality of vertical ribs disposed in the protruding middle section configured to engage the plurality of vertical ribs of the transparent inner cap during assembly of the assembled two-piece closure to assist in preventing the opaque outer cover from being axially rotated without a corresponding rotation of the transparent inner cap.

4. A closure system comprising:

an opaque outer cover having an open top, an open bottom and a circumferential sidewall extending down from the open top to the open bottom; and a transparent inner cap including a top wall, an open bottom, a circumferential sidewall extending down from the top wall to the open bottom, and a closure engaging mechanism disposed on an interior surface of the sidewall configured to contact and interact with a corresponding container engaging mechanism for removably applying the closure system to a container, the transparent inner cap dimensioned and configured to be inserted into the opaque outer cover for affixing the opaque outer cover to the transparent inner cap such that the opaque outer cover is unable to be axially rotated without a corresponding rotation of the transparent inner cap to form an assembled two-piece closure wherein the sidewall of the opaque outer cover substantially covers the sidewall of the transparent inner cap, and wherein each of an interior surface of the sidewall of the opaque outer cover and an exterior surface of the sidewall of the transparent inner cap include one of a protruding middle section and a corresponding recessed middle section extending radially around their respective sidewall, the protruding middle section operable to engage the recessed middle section for affixing the opaque outer cover to the transparent inner cap to form the assembled two-piece closure, wherein the closure system further includes a disc-shaped liner operable to be inserted into a cavity formed between the top wall and the circumferential sidewall of the transparent inner cap such that the liner is visible through the open top of the opaque outer cover and the top wall of the transparent inner cap of the assembled two-piece closure, and wherein the exterior surface of the sidewall of the transparent inner cap includes an angled surface adjacent the open bottom that is angled inwardly toward the open bottom of the transparent inner cap to facilitate traversal of the exterior surface of the sidewall of the transparent inner cap along the sidewall of the interior surface of the opaque outer cover when the transparent inner cap is pushed through the open top of the opaque outer cover during assembly of the assembled two-piece closure.

5. The closure system of claim 4 wherein the protruding middle section includes an angled surface and the recessed middle section includes a corresponding angled surface to facilitate assembly of the two-piece closure.

6. The closure system of claim 4 wherein the transparent inner cap includes a plurality of vertical ribs disposed along the protruding middle section and the opaque outer cover includes a plurality of vertical ribs disposed in the recessed middle section configured to engage the plurality of vertical ribs of the transparent inner cap during assembly of the assembled two-piece closure to assist in preventing the opaque outer cover from being axially rotated without a corresponding rotation of the transparent inner cap.

* * * * *